US005931356A

United States Patent [19]

Lillelund et al.

[11] Patent Number: 5,931,356

[45] Date of Patent: Aug. 3, 1999

[54] DISPENSER FOR OIL/VINEGAR BOTTLE

[75] Inventors: Stig Lillelund, Gentofte; Jakob Heiberg, Charlottenlund; Hanne Dalsgaard Jeppesen, Holte, all of Denmark; Johan M.J.K. Mortier, Grimminge; Robert H.C.M. Daenen, Essene, both of Belgium

[73] Assignee: Dart Industries Inc., Orlando, Fla.

[21] Appl. No.: 08/883,133

[22] Filed: Jun. 27, 1997

[51] Int. Cl.[6] ..... B67D 3/00

[52] U.S. Cl. ..... 222/485; 222/519; 222/549

[58] Field of Search ..... 222/485, 519, 222/549, 568

[56] References Cited

U.S. PATENT DOCUMENTS

| | | | |
|---|---|---|---|
| 50,620 | 10/1865 | Parise et al. . | |
| D. 199,994 | 1/1965 | Knodt | D44/22 |
| D. 267,781 | 2/1983 | Thompson | D9/7 |
| D. 267,782 | 2/1983 | Thompson | D9/7 |
| D. 377,145 | 1/1997 | Huser | D9/447 |
| 789,230 | 5/1905 | Peacock . | |
| 2,715,480 | 8/1955 | Livingstone | 222/111 |
| 3,628,697 | 12/1971 | Dowson | 222/111 |
| 3,980,211 | 9/1976 | Owens | 222/478 |
| 4,193,519 | 3/1980 | Dubach et al. | 222/111 |
| 4,600,131 | 7/1986 | Roof et al. | 222/478 |
| 4,836,419 | 6/1989 | Metz et al. | 222/110 |
| 4,844,302 | 7/1989 | Lay | 222/568 |
| 4,890,770 | 1/1990 | Haga et al. | 222/109 |
| 5,431,306 | 7/1995 | Reid | 222/111 |
| 5,472,120 | 12/1995 | Stebick et al. | 222/153.06 |
| 5,566,862 | 10/1996 | Haffner et al. | 222/111 |

*Primary Examiner*—Joseph A. Kaufman
*Attorney, Agent, or Firm*—John A. Doninger; Taylor J. Ross

[57] ABSTRACT

A dispenser including a bottle-mountable pour adapter with a central discharge spout and lateral discharge openings made selectively accessible by a removable cap capable of vertical adjustment relative to the adapter by cooperating cam elements on the cap and adapter.

4 Claims, 3 Drawing Sheets

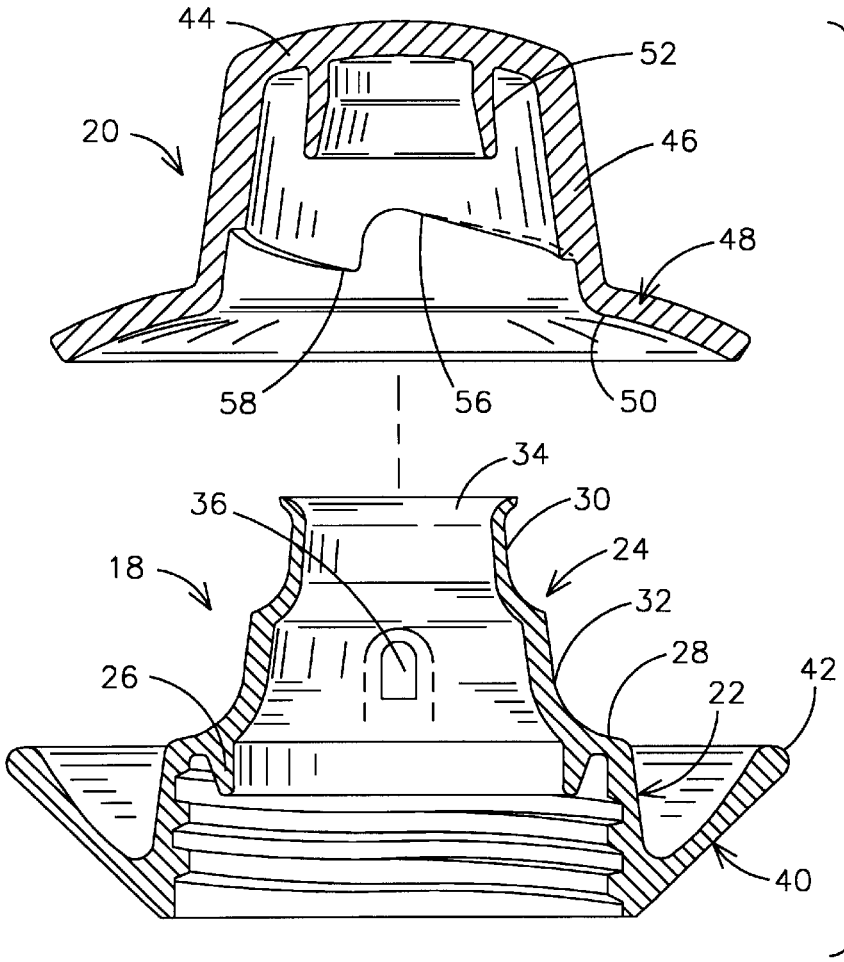
FIG. 5
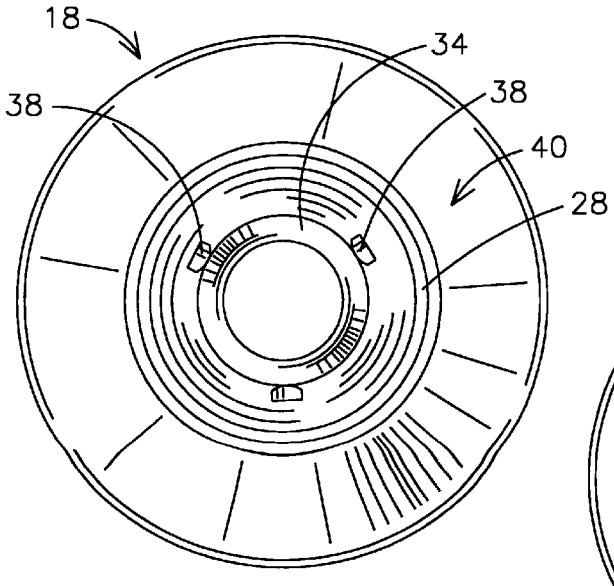
FIG. 6
FIG. 7
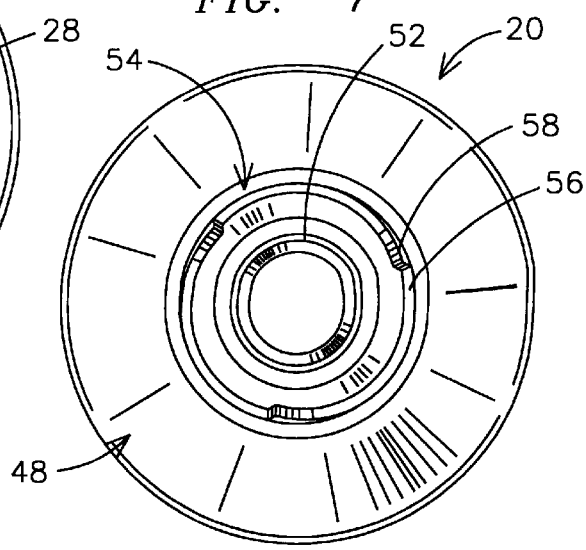

DISPENSER FOR OIL/VINEGAR BOTTLE

BACKGROUND OF THE INVENTION

Cruets, commonly used for the dispensing of oil, vinegar, and like liquid condiments, while basically consisting of a glass bottle with a pour spout and stopper, are frequently provided with separate pour adapters or fitments.

Such adapters or fitments are provided for a variety of reasons, including enhanced sealing of the bottle, regulating the flow therefrom, avoidance of drippage, and the like.

SUMMARY OF THE INVENTION

The present invention proposes a dispenser including a pour adapter or fitment which mounts in the manner of a screw cap to the externally threaded neck of a liquid container or bottle, and a cap which mounts to the adapter in an adjustable manner and controls the dispensing of the liquid contents of the bottle.

A significant object of the invention is to provide a unique dispenser which allows for use of the cruet both at the dining table wherein a closely controlled pouring is desired, and for kitchen preparation wherein a more generous flow is normally preferred.

It is significant that multiple dispensing options are achieved through a simple although unique rotational manipulation of the cap relative to the pour adapter utilizing interacting cams and cam following surfaces provided on the adapter and cap. Basically, the cam assembly as illustrated will, through a rotation of the cap approximately 120°, move the cap between a fully seated and sealed position and an elevated controlled pour position for table use. In this pour position, discharge is through side ports in the spout below the spout mouth with the flow guided by an annular collecting collar integral with the base. It is significant that a more generous flow, as might be desired in kitchen preparation, is prevented by means of a depending sealing plug within the cap which engages within the mouth of the discharge spout of the pour adapter and remains in sealing engagement therewith throughout the range of cam adjustment of the cap relative to the adapter.

The cap, in addition to controlling table pouring and providing a positive sealing of the pour adapter, is also completely removable from the pour adapter by a vertical separation of the cap therefrom, this separation, possibly simplified by a slight twisting motion of the cap relative to the adapter, disengages the sealing plug from the main discharge spout. With the cap thus removed from the adapter, upon an inverting of the bottle, the contents will flow freely through the spout, substantially bypassing the side ports utilized in the controlled pour position.

It is a further significant object of the invention that provision be made for collection of any spillage, particularly in those instances wherein the cap is removed and a more generous flow achieved, by utilizing the annular collecting collar which extends upwardly and outwardly about the base below the spout.

Other features, objects and advantages of the invention will be noted from the more detailed description following hereinafter.

BRIEF DESCRIPTION OF THE DRAWINGS

FIG. 5 is a further cross-sectional illustration wherein the cap is fully removed to allow for maximum discharge through the spout;

FIG. 6 is a top plan view of the pour adapter; and

FIG. 7 is a bottom plan view of the cap.

DESCRIPTION OF PREFERRED EMBODIMENT

Figure 1:
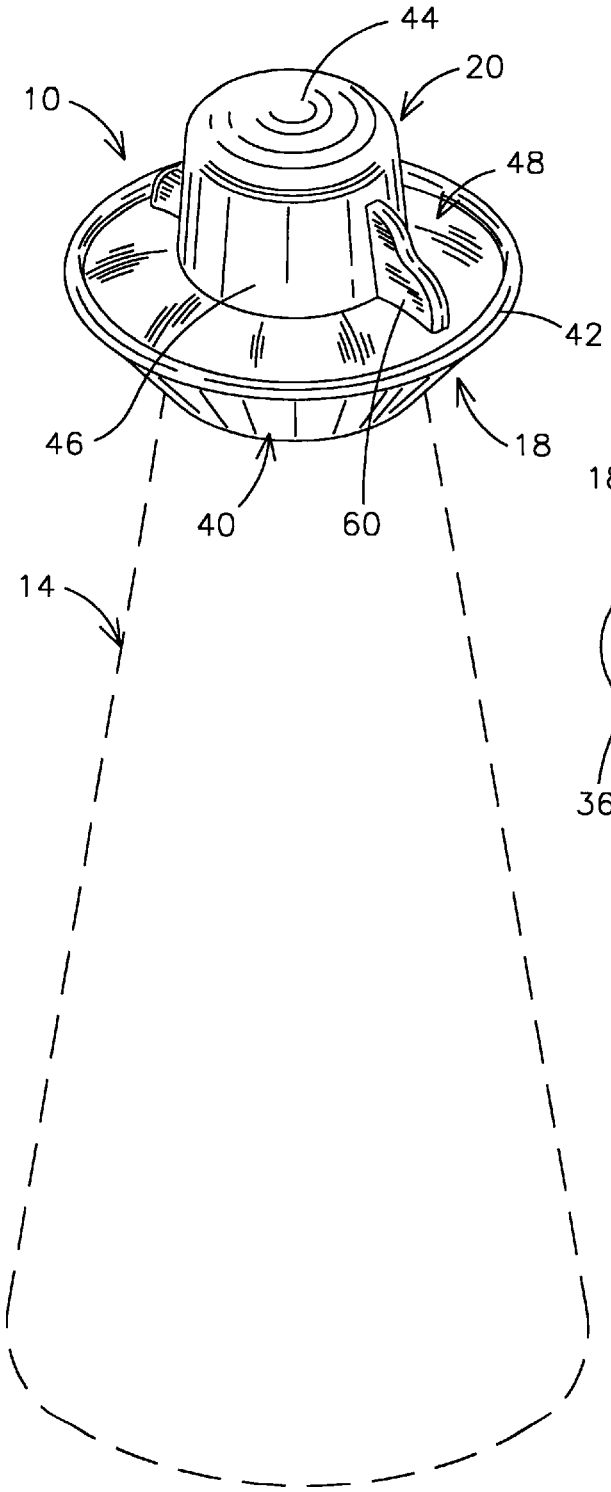
FIG. 1 is a perspective view of the assembled and closed dispenser mounted to a container or bottle illustrated in phantom lines.

Referring now more specifically to the drawings, the dispenser 10 is particularly adapted to threadedly mount to the externally threaded neck 12 of an appropriate container or bottle 14 and engage in a sealed manner with the open mouth 16 at the discharge end of the neck 12. While not limited to, the dispenser and bottle combination is principally intended for use in the dispensing of oil or vinegar, and will usually be provided in a set, one for oil and one for vinegar, for both table and kitchen use.

The dispenser 10 includes a pour adapter 18 and a sealing cap 20. The adapter 18, which can also be considered a fitment, is preferably a unitary item molded of an appropriate synthetic resinous material and includes a cylindrical internally threaded mounting base 22 with a spout 24 extending coaxially therefrom and upward relative thereto in the upright position illustrated in the drawings.

Figure 4:
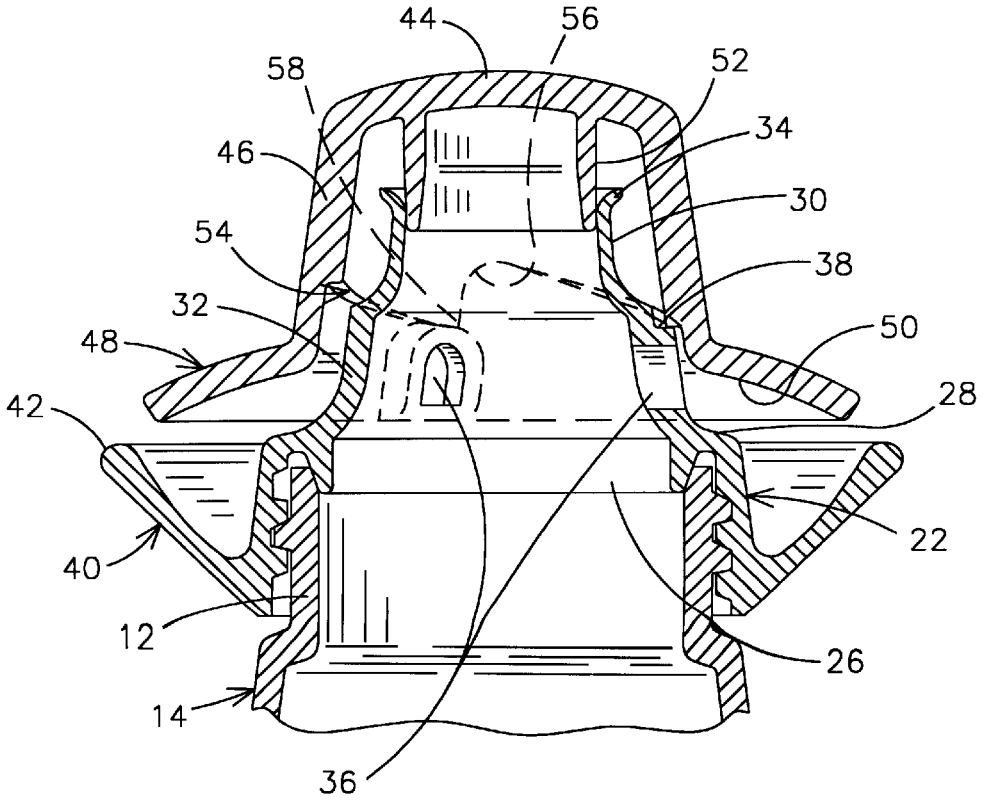
FIG. 4 is a similar cross-sectional view with the cap cam-elevated to the limited pour position.

As noted in FIG. 4, the mounting base threadedly engages with the externally threaded bottle neck 12 and is sealed thereto by means of an annular depending sleeve 26 which, upon a full seating of the mounting base 22, frictionally and sealingly engages with and within the mouth 16 of the bottle neck 12.

The spout 24 is peripherally inwardly offset relative to the mounting base 22 to define an annular upwardly directed sealing shoulder 28 peripherally about the spout. The upper portion 30 of the spout, which is equal to approximately one-half the height of the spout 24, is radially or peripherally reduced relative to the lower spout portion 32 immediately above the shoulder 28, and terminates in an upper outwardly flaring pouring lip 34 which defines the discharge mouth of the spout 24. So configured, it will be appreciated that the flow discharge path is gradually reduced, in a stepped manner, from the enlarged bottle mouth 16 to the discharge mouth of the spout 24 for a more exact control of the discharging liquid.

Figure 2:
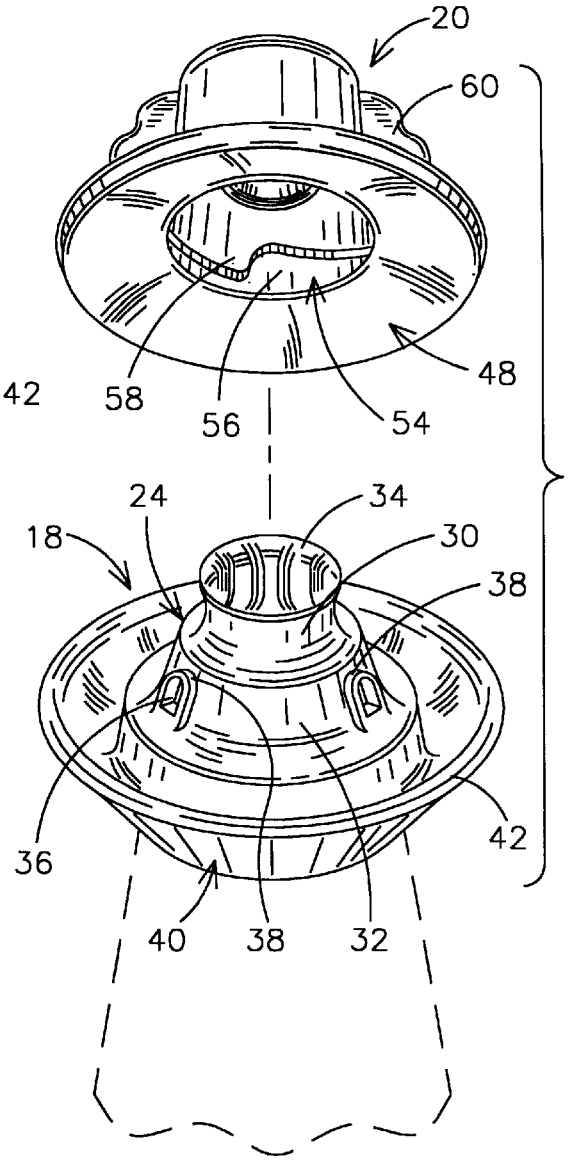
FIG. 2 is a perspective view with the cap exploded from the pour adapter or fitment.

A series, preferably three, of dispensing ports 36, are defined transversely through the lower spout portion 32 of the spout 24 at equally spaced points thereabout. These ports 36, as illustrated, can be of a Palladian configuration. The inner surface of the lower spout portion 32 is uninterrupted, particularly adjacent the ports 36, to allow for a free discharge therethrough as shall be explained subsequently. The external surface of this lower spout portion 32 is outwardly enlarged about each of the ports, note FIG. 2 in particular, and defines a series of upwardly convex radially outwardly projecting cams 38.

As an assist to a controlling of the pouring of the oil or vinegar through the ports 36, and as a means for controlling spillage during both table use and kitchen preparation use wherein a more generous flow through the spout is desired, the adapter 18 is provided with an annular upwardly and outwardly flaring collar 40 having an inner periphery integrally formed with and sealed to the lower peripheral edge portion of the mounting base 22 and a free upper and outer edge portion 42. This edge portion 42, as illustrated, is slightly bulbous and will tend to control drippage thereat and, upon an upright positioning of the bottle after use, tend to inwardly and downwardly direct any liquid not specifically dispensed. This collar 40 extends to a height approximately at or slightly below the sealing shoulder 28.

The cap 20 includes a slightly domed circular top panel 44 with a depending wall 46 integral with the periphery of the top panel 44 and tapering slightly outward from the top panel to a lower annular outwardly and downwardly flaring flange 48.

Figure 3:
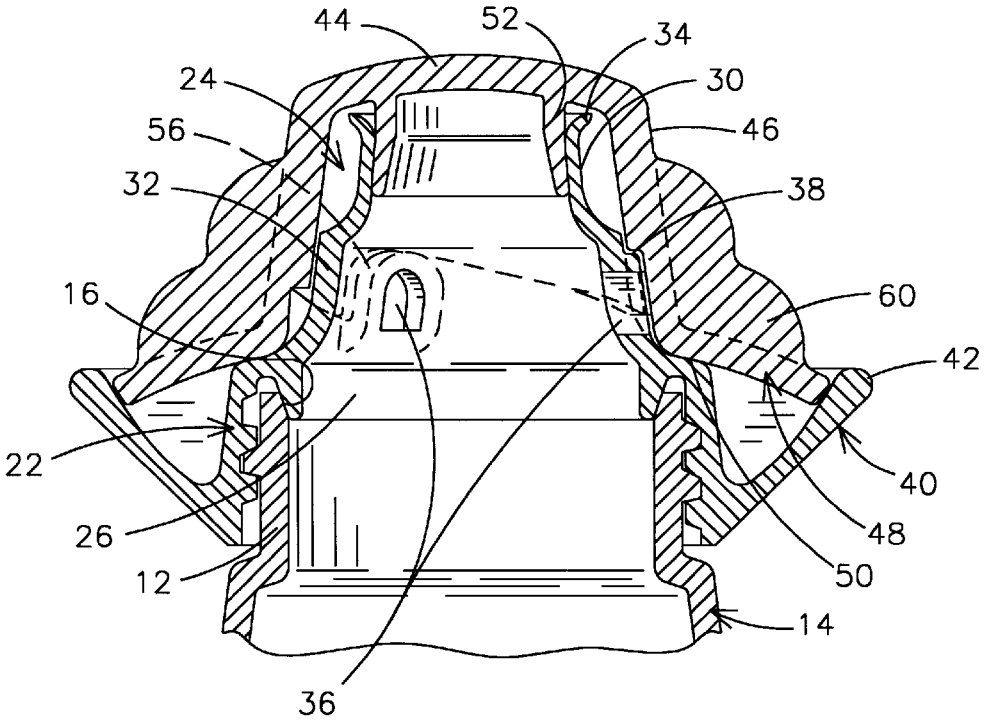
FIG. 3 is an enlarged cross-sectional view through the dispenser with the cap in its fully seated and sealing position.

The depending wall 46 is of a height as to allow for a complete reception of the spout 24 of the pour adapter 18 within the cap as the cap fully seats, note FIG. 3. With continued reference to this figure, it will be seen that the outer peripheral edge of the flange 48 is closely received within the upper portion of the annular collar 40. When so received, the lower edge of the depending wall 46 and the undersurface of this flange 48, immediately outward of the lower periphery of the cap wall 46 and in the general area indicated by reference numeral 50, engages against the upper surface of the sealing shoulder 28, below the ports 36, with no clearance, thereby providing a positive seal against any leakage or spillage from discharge through the ports.

It is similarly desirable to effect a positive liquid tight seal within the upper portion of the spout 24 immediately inward of the pouring lip 34. Accordingly, the top panel 44 of the cap 20 is provided with a centrally located integral depending plug 52, preferably hollow as illustrated and receivable with a liquid tight friction fit within the upper portion 30 of the spout 24. This positive-sealing friction fit, which retains the cap mounted on the adapter, is retained throughout the vertical adjustment of the cap relative to the pour adapter between the fully closed position of FIG. 3 and the initial pour position wherein flow is allowed through the ports 36 as in FIG. 4. As such, the height of the plug 52, and the external configuration thereof, along with the internal configuration of the upper portion of the spout, is such as to maintain positive engagement throughout this range of adjustment. It is contemplated that the inherent nature of the material used in the formation of the adapter and cap incorporate a degree of flexible resiliency which contributes to the effectiveness of the seal provided between the plug 52 and the spout throughout the designated range of movement. As will be recognized, when it is desired to obtain maximum flow directly through the spout itself, it is only necessary to completely remove the cap as suggested in FIG. 2.

Vertical movement of the cap 20 between the fully seated of FIG. 3 and the port-exposing position of FIG. 4 is achieved through a cam arrangement utilizing the previously described cams 38, one overlying each of the ports 36, and a continuous downwardly directed cam following edge 54 defined on or from the inner surface of the depending wall 46 and in engagement with the cams 38. Assuming three ports 36 and associated cams 38, the cam following edge 54 will be defined in three corresponding sections, the configuration of each gradually varying, in the desired direction of the rotation, between an upwardly recessed portion 56 and a depending lobe 58. Each recessed portion 56, upon receiving the corresponding cam 38 therein, as in FIG. 3, allows for a fully sealed seating of the cap 20. Each depending lobe 58, traveling on the associated cam 38, automatically upwardly adjusts the cap 20 to the port-exposing position of FIG. 4. Continued rotation of the cap 20 relative to the pour adapter 18 will simultaneously move all of the lobes 58 beyond the associated cams and allow for a subsequent downward movement of the cap to its fully seated position with the cams within the cam following edge recesses 56. As will be recognized, the cap 20 can also be fully seated by a reverse rotation of the cap.

The vertical distance between the two extremes of the portions of the cam following edge 54 is such as to vertically move the cap 20 relative to the pour adapter 18 a distance which while sufficient to expose the ports 36, is less than the vertical height of engagement between the plug 52 and interior of the spout 24 whereby the discharge mouth of the spout, with the pour lip 34 thereabout, continues to be sealed against any liquid discharge therethrough. As will be recognized, in rotating the cap, a slight downward pressure will be exerted thereon to maintain contact between the cams and cam following edge. Further, in order to facilitate a rotation of the cap, a pair of diametrically opposed integral wings 60 extend from the cap side walls 46 and radially across a major portion of the cap flange 48.

In use, and when the particular liquid condiment is to be used in moderation, the cap 20 is rotated from its fully seated and sealing position to the partially open position of FIG. 4 whereat limited discharge through one or more of the ports 36, depending on the manner in which the bottle is tilted, will flow into the collar 40, move to the lowest outer rim part thereof, and discharge therefrom on the foodstuff. The peripheral collar 40 avoids the necessity of specifically aligning one of the ports 36 with the specific discharge point from the collar 40 in that any discharging liquid will be trapped and directed by the collar 40. Inasmuch as the cam following edge provides for a progressive change in the position of the cap relative to the pour adapter, and more particularly the ports 36, some variation can be achieved in the discharge flow rate therethrough.

When a greater flow is required, as in kitchen preparation situations, the cap is removed in its entirety, and the flow is effected through the enlarged open mouth of the spout as defined by the pouring lip 34. Any spillage will be effectively retained by the annular collar 40.

The foregoing is considered illustrative of the invention. As obvious variations might occur to those skilled in the art, it is not intended to limit the invention to the specific embodiment disclosed. Rather, the invention is considered to encompass all embodiments falling within the scope of the claims following hereinafter.

We claim:

1. A dispenser for liquid condiments, comprising:

a pour adapter mountable to a container, said adapter including a mounting base;

a plurality of cams, each extending from said adapter at peripherally spaced positions above said sealing shoulder; and a spout extending upward from a position above said cams; and a cap selectively mountable upon said pour adapter, said cap including a top panel;

a plug extending downward from said top panel, said plug being sized for a friction fit within said spout and to seal same when received therein;

a depending sleeve extending downward from a periphery of said top panel; and a plurality of cam follower edges on an inner face of said depending sleeve, each said cam follower edge extending from a recessed portion to a depending lobe, said cam follower edges each engaging an associated one of said cams such that rotation of said cap with respect to said pour adapter in a first direction will move said cap vertically with respect to said pour adapter, said plug being received within said spout when said cams are located in proximity to said recessed portions.

2. A dispenser for liquid condiments as in claim 1, wherein said pour adapter further includes a collar extending peripherally outward and upward from said mounting base.

3. A dispenser for liquid condiments as in claim 2, wherein said cap further includes a flange extending peripherally outward and downward from a free edge of said depending sleeve, a peripheral edge of said flange contacting said collar when said cap is fully seated upon said pour adapter.

4. A dispenser as in claim 1, wherein said pour adapter further includes a port extending therethrough at each of said cams, and wherein said cam follower edge is located such that when said cams are in proximity to said depending lobe said cap is raised vertically with respect to said pour adapter to expose said ports.

* * * * *